US006241513B1

(12) United States Patent
Jeneral

(10) Patent No.: US 6,241,513 B1
(45) Date of Patent: Jun. 5, 2001

(54) CANDLE CUP

(76) Inventor: John A. Jeneral, One Stage Coach Rd., Southwick, MA (US) 01077

( * ) Notice: Subject to any disclaimer, the term of this patent is extended or adjusted under 35 U.S.C. 154(b) by 0 days.

(21) Appl. No.: 09/545,706

(22) Filed: Apr. 7, 2000

(51) Int. Cl.[7] ..... F21V 35/00

(52) U.S. Cl. ..... 431/291; 431/289; 431/292; 362/161; 362/806; 362/807

(58) Field of Search ..... 431/291, 292, 431/289; D26/9, 10, 11, 16, 19, 22; 362/161, 806, 807

(56) References Cited

U.S. PATENT DOCUMENTS

| | | | | |
|---|---|---|---|---|
| Re. 24,423 | | 2/1958 | Oesterle et al. | 67/21 |
| D. 83,100 | * | 1/1931 | Gisolfi . | |
| D. 122,877 | * | 10/1940 | Nicholson . | |
| D. 195,601 | * | 7/1963 | Bostrom, III . | |
| 383,682 | | 6/1888 | Clarke . | |
| D. 415,295 | * | 10/1999 | Kochis et al. . | |
| 1,344,446 | * | 6/1920 | Engman . | |
| 1,945,953 | | 2/1934 | O'Connell | 67/21 |
| 2,001,312 | | 5/1935 | O'Connell | 67/21 |
| 3,679,119 | * | 7/1972 | Copping . | |
| 3,799,493 | * | 3/1974 | Beck et al. . | |
| 3,921,801 | * | 11/1975 | Sway . | |
| 3,951,266 | * | 4/1976 | Brewer . | |
| 4,268,002 | * | 5/1981 | Deveaux . | |
| 4,388,334 | * | 6/1983 | Deveaux . | |
| 4,759,699 | | 7/1988 | Rubarth | 431/291 |
| 5,968,564 | * | 10/1999 | Welsh et al. . | |

FOREIGN PATENT DOCUMENTS

| | | | | |
|---|---|---|---|---|
| 2626961 | * | 10/1989 | (FR) | 431/294 |

* cited by examiner

*Primary Examiner*—Carl D. Price
(74) *Attorney, Agent, or Firm*—McCormick, Paulding & Huber, LLP

(57) ABSTRACT

A polycarbonate thermoplastic plastic candle cup for a tea-light candle is disclosed having raised designs on the interior surface of the cup to increase the surface area on which non-liquid wax adheres, thus providing an improved insulating layer of non-liquid wax between the plastic and the candle flame.

3 Claims, 2 Drawing Sheets

CANDLE CUP

FIELD OF INVENTION

This invention relates to a novel container made of polycarbonate plastic for 'tea light' candles.

BACKGROUND OF THE INVENTION

'Tea-light' candles, used for decorative or votive lighting or as a source of heat for a chafing dish, are candles formed by introducing wax into either metal or flame-resistant plastic cups around a central wick. The typical tea-light candle burns for 4–6 hours in cups of 38 mm (1.5 in.) in diameter and 15 mm (⅝ in.) in height.

The cups, which retain the melted wax as the wick burns, are usually placed in non-flammable glass or ceramic candle holders that are well ventilated to allow heat conducted through the cup to dissipate by convection.

Plastic cups manufactured using injection molding techniques are a low cost alternative to metal cups for the tea-light candle, but plastic has an inherently lower ignition point than metal and conventional plastic cups have been known to ignite.

Plastic candle holders in the prior art, for example, U.S. Pat. No. 4,759,699 entitled "PLASTIC CUP HOLDER FOR FLAMING CANDLE", are not directed to tea-light candles where the wax is in direct contact with the cup walls and the cup itself forms part of the candle. The plastic candle holder of the '699 patent is specifically designed to hold a standard wax candle away from the plastic wall and base of the candle holder.

OBJECTS AND SUMMARY OF THE INVENTION

It is an object of the present invention to provide a safer plastic cup for se in tea-light candles.

It is another object of the invention to provide a plastic cup for tea-light candles that can be used with or without a glass or ceramic candle holder.

It is another object of the invention to provide a plastic cup for tea-light candles that may have any one of a variety of decorative shapes and colors.

The present invention is directed to a novel plastic cup for use in tea-light candles. Enhanced safety is achieved by incorporating raised designs into the interior base of the cup to increase the interior surface area of the cup on which an insulating layer of unmelted wax can adhere.

DETAILED DESCRIPTION OF THE PREFERRED EMBODIMENT

Figure 1:
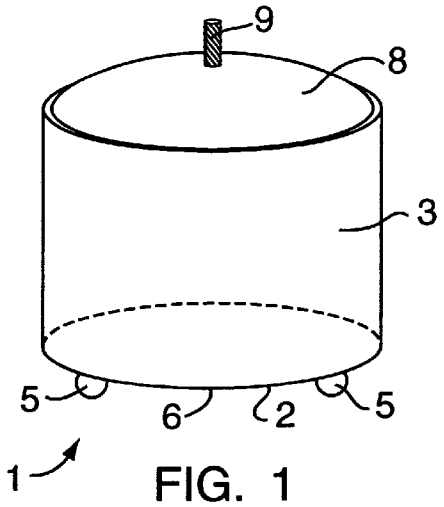
FIG. 1 depicts a schematic view of a tea-light candle using a novel plastic cup.

Referring to FIG. 1, a novel plastic cup 1 for use with a tea-light candle is depicted. The plastic cup is preferably made of a moldable thermoplastic plastic resin that is suitable for injection molding and exhibits good clarity, heat and ignition resistance, and capable to be modified with respect to color, UV stability and mold release characteristics. The preferred thermoplastic plastic is a polycarbonate, which is commonly sold under several tradenames, including LEXAN®, manufactured by GE Plastics; MAKROLON®, manufactured by Bayer Corporation; and CALIBRE®, manufactured by Dow Chemical Company.

The candle cup 1 of the present invention has a substantially flat and continuous base 2 and integral sidewall 3 forming a container into which wax 8 is introduced around a wick 9 to make a 'tea-light' candle. Plastic feet 5 on the bottom external surface 6 of the base 2 allow air flow around the exterior of the cup to cool the tea-light candle by convection.

Figure 2:
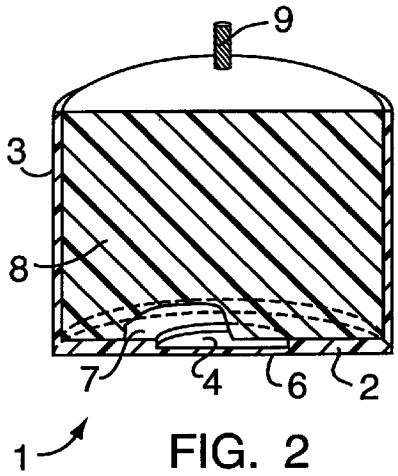
FIG. 2 is a schematic view of the the candle cup of the present invention.

Referring to FIG. 2, a recess 4 centered in the internal surface 7 of the base 2 collects liquid wax as the candle burns. As the liquid wax concentrates in the recess 4, non-liquid wax adheres to the remaining interior surface area of the base which is relatively cooler. Because the coating of non-liquid wax on the interior surface area of the cup acts as an insulator, it is desirable to maximize the interior surface area in order to keep the temperature of the cup well below the ignition point of the plastic. The present invention is directed to increasing the cooler interior surface area of the cup.

Figure 3A:
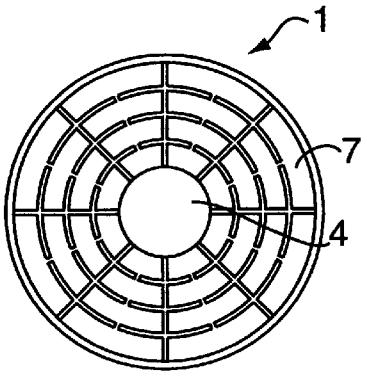
FIGS. 3*a* and 3*b* depict the base of the candle cup of the present invention.
Figure 3B:
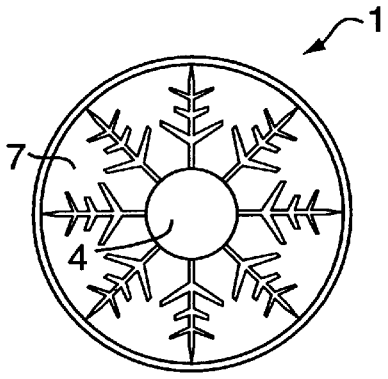

Referring to FIGS. 3*a* and 3*b*, in the candle cup of the present invention, raised designs are molded into the interior surface 7 of the base of the cup to increase the surface area on which the non-liquid wax adheres without blocking the flow of wax in the recess. Two such designs are shown in FIGS. 3*a* and 3*b* respectively, but it will be recognized that virtually an unlimited number of designs may be used with equal effect.

Figure 4:
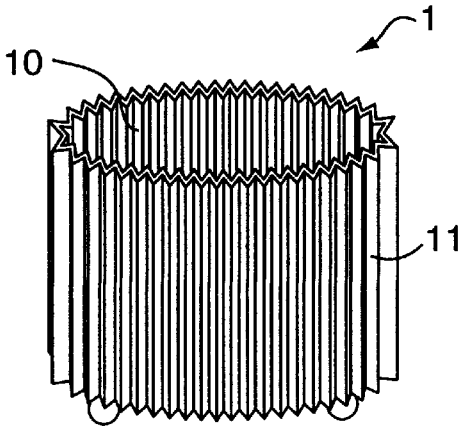
FIG. 4 is a schematic view of a second embodiment of the candle cup of the present invention in which the sidewalls of the cup are fluted.

Referring to FIG. 4, in a second embodiment of the present invention, the interior surface area 10 of the cup may be further enlarged by fluting the interior of the sidewall 11 as shown. Other functional designs on the interior sidewall will occur to those skilled in the art.

Figure 5:
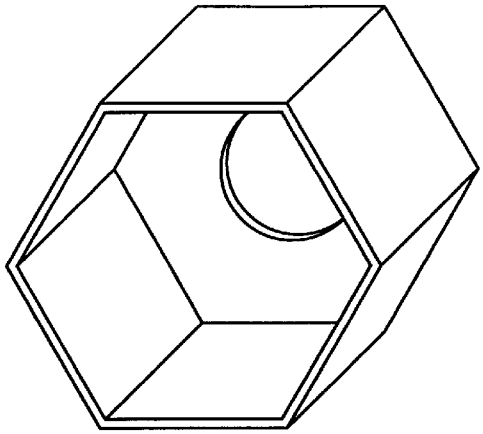
FIG. 5 is a schematic view of the candle cup of the present invention in the shape of a hexagon.
Figure 6:
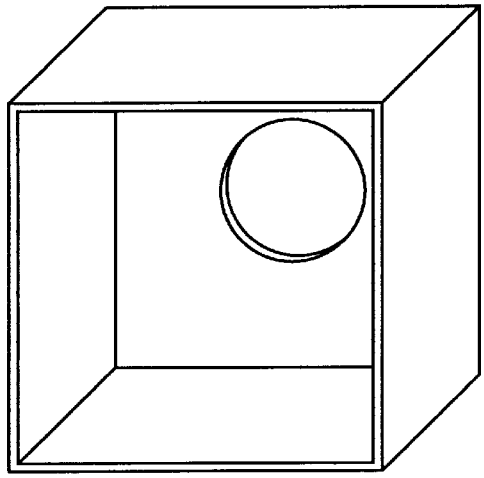
FIG. 6. is a schematic view of the candle cup of the present invention in the shape of a square.
Figure 7:
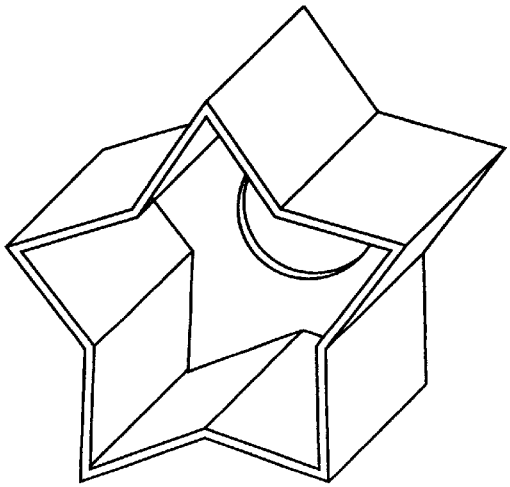
FIG. 7. is a schematic view of the candle cup of the present invention in the shape of a star.

Injection molding techniques make it possible to produce tea-light candle cups in a wide variety of decorative shapes and sizes. As shown in FIGS. 5, 6, and 7, for example, the plastic cups of the present invention may be manufactured in shapes such as the hexagon, square, and star shapes shown and in different sizes. Novelty shapes in the form of particular objects or animals may also be readily manufactured using plastic injection molding techniques.

Using colored polycarbonate plastic resins, the candle cup of the present invention may also be manufactured in a variety of colors to create an artistic tea-light candle.

While the preferred embodiment of the present invention is illustrated and described, those of ordinary skill in the art will recognize that various modifications and substitutions may be made thereto without departing from the spirit and scope of the invention.

I claim:

1. A flame-retardant plastic cup for a tea-light candle comprising:

a substantially flat and continuous base and integral sidewall formed of flame-retardant thermoplastic, having interior and exterior surfaces, the interior surface of said base having a centrally located recess for receiving liquid wax therein, said recess having a continuous outer perimeter about the center of said substantially flat and continuous base, and;

wherein the interior surface of said substantially flat and continuous base includes a portion between said outer perimeter and said sidewall, said portion having raised designs for wax adhesion thereon while permitting wax flow to the centrally located recess, said raised designs including at least one discontinuous element oriented in a non-radial direction, and wherein said portion exclusive of said raised designs is substantially flat and continuous.

2. A plastic cup as in claim 1 wherein the interior surface of said sidewall is fluted.

3. A plastic cup as in claim 1 further comprising plastic feet on the exterior surface of said base to allow air flow around the entire exterior surface of said cup.

* * * * *